US006355329B1

(12) United States Patent
Rose et al.

(10) Patent No.: US 6,355,329 B1
(45) Date of Patent: Mar. 12, 2002

(54) ROOFING

(75) Inventors: Alfredo P. Rose, Newport; Theodore A. Saillant, Woonsocket; Stephen A. Siener, Greene, all of RI (US)

(73) Assignee: Cooley, Incorporated, Pawtucket, RI (US)

( * ) Notice: Subject to any disclaimer, the term of this patent is extended or adjusted under 35 U.S.C. 154(b) by 0 days.

(21) Appl. No.: 09/452,226

(22) Filed: Dec. 1, 1999

(51) Int. Cl.[7] ..... B32B 5/08
(52) U.S. Cl. ..... 428/110; 428/192; 442/58
(58) Field of Search ..... 428/110, 113, 428/192; 442/58

(56) References Cited

U.S. PATENT DOCUMENTS 4,468,422 A 8/1984 Siener, Jr. et al.

*Primary Examiner*—Alexander S. Thomas

(57) ABSTRACT

Roofing of plastic sheet (preferably very flexible polypropylene) has embedded in it reinforcing threads of a higher tenacity (preferably ultra high molecular weight polyethylene) in a narrow mounting area along a panel edge, and other threads of lower tenacity in other areas of the panel (and preferably in the mounting area as well), the threads being preferably weft-knitted with nine by nine thread count throughout.

28 Claims, 1 Drawing Sheet

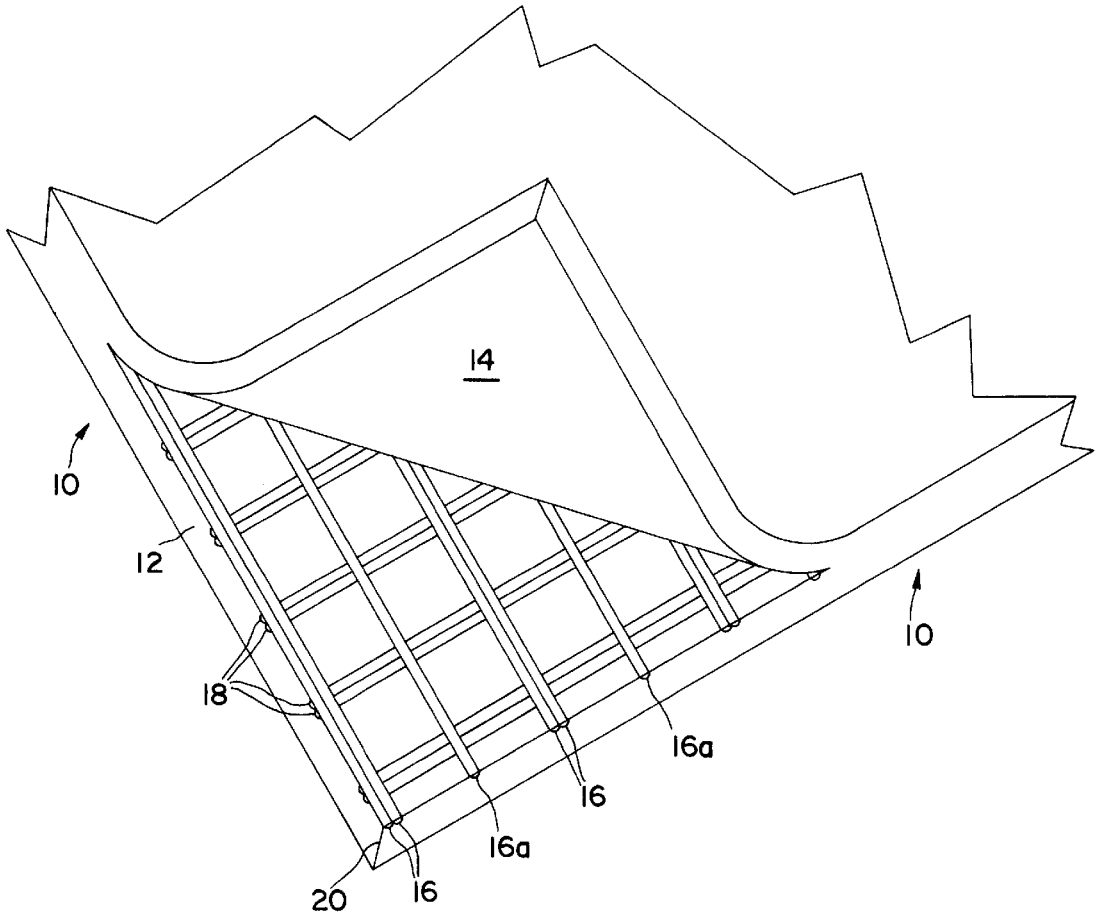
14
10
12
18
20
16
16a
16a
16
10

ROOFING

FIELD

This invention relates to roof coverings, and more particularly to sheet products useful in such coverings.

BACKGROUND

U.S. Pat. No. 4,468,422, "Material Useful As Roofing", Siener, Jr. et al., granted Aug. 28, 1984, taught including, along one warp-direction edge of sheet roofing, low-elongation aramid reinforcing strands, in a weft-inserted reinforcing fabric sandwiched between two chlorinated polyethylene plastic layer portions, for holding down by plates spaced along the same direction, to improve wind uplift resistance. That patent also taught use of polyester strands of 1000 denier as other reinforcing threads in the warp direction, and doubletons in the fill. Said patent is hereby incorporated by reference herein.

Also known in the prior art are roofing sheet panels in which the two layer portions of plastic formed into single-ply are polypropylene, sandwiching a layer of weft-inserted reinforcing fabric, in which both warp and fill are of polyester singleton threads all alike.

More than a year ago, our company (assignee hereof) sold roof panels in which layer portions of polyvinyl chloride created a single-ply sandwich with a low-stress weft-inserted reinforcing fabric layer which included a mounting area immediately adjacent a warp edge and strengthened against elongation by inclusion of, for a four-inch width, alternating warp "threads" of 1500 denier aramid singletons and 2000 denier (paired 1000's) high breaking tenacity polyester doubletons. The warp threads outside the mounting area were 1000 denier high breaking tenacity polyester singletons. All the fill threads were doubletons of that same polyester yarn (making each of these effectively threads, using "thread" as "knitted as one", and so treated in "thread count" and so used herein throughout) of 2000 denier. Thread count was 9×9 throughout. Factory Mutual Company in December, 1997 approved this product with an I-90 (pounds per square foot of uplift) wind resistance rating with hold-down fasteners spaced twelve inches apart. (This sale was regarded as experimental, although the customer was not so informed, and is not conceded to be relevant prior art.)

SUMMARY

This invention is based in one aspect on the discovery that, for a reason or reasons not fully understood, strands of ultra-high-molecular-weight polyethylene (UHMWPE) provide, when included as reinforcing strands in narrow mounting areas along edges of panels of sheet roofing, exceptionally useful aid in increasing wind uplift resistance, particularly with polypropylene as the single-ply plastic.

In preferred embodiments, the sheet of the invention is of single-ply polypropylene, in which is intermediately embedded a reinforcing low-stress weft-inserted fabric in which the mounting area is along a longitudinal, warp-thread directional, edge of each panel, of width slightly greater than the outside diameter of hold-down ring-edged "pressure plates" that engage it; the UHMWPE threads are warp strands and the mounting area includes also warp threads of lower tenacity and lower breaking strength, fill threads being throughout the sheet of lesser "tenacity" (i.e., as used herein throughout, breaking tenacity) than the UHMWPE strands.

In another aspect, the invention provides such sheet roofing panels in which the fabric layer of a single-ply sandwich comprises three reinforcement areas: a mounting edge area with first and second threads extending in a direction corresponding to that of a row of fasteners for hold-down units and respectively of a first higher tenacity and a second lower tenacity; a second area corresponding to the locus of all reinforcing threads outside said mounting edge area and including third threads parallel with said first threads and in which said third threads are of a second, lower tenacity and a first lower breaking strength; and a third area consisting of the entire panel, and in which fourth reinforcing threads are perpendicular to said first and second threads and are of said lower tenacity but of a second higher breaking strength.

In most preferred embodiments in this aspect, the first threads are of UHMWPE, alternating with threads of polyester doubletons, the third threads are polyester singletons, and the fourth are polyester doubletons; and thread count is uniform and 9×9 throughout.

PREFERRED EMBODIMENT

There follows a description and drawing of the presently preferred embodiment.

DRAWING

The FIGURE is an isometric view, broken away, of a broken-out corner of said embodiment.

DESCRIPTION

Indicated generally at 10 is a sheet product very useful as roofing to cover large flat roofs.

Sheet 10 includes very flexible plastic base portion 12, plastic cover portion 14 cohered to portion 12 (whereby "single-ply", therewith) except at warp strands 16 and 16*a* and fill ("weft", "woof") strands 18 (two strands 16 or 18 providing a "thread), held between portions 12 and 14 thereby. Overall sheet 10 thickness is 0.040 inches. Each portion 12 and 14 has a thickness of 0.020 inches, and is formulated from polypropylene resin. Bottom portion 12 is gray, and top portion 14 is white; both are formulated by UVTEC, 1121 108th Street, Arlington, Tex. 76011, under compound numbers FR 7077 (top portion 14) and FR 7078 (bottom portion 12) using polypropylene resins sold by Montell USA, Inc., Two Little Falls Center, 2751 Centerville Road, Wilmington, Del. 15439, under the numbers KS358P (top portion 14) and KS359P (bottom portion 12). Each of portions 12 and 14 include and contain in the extrusion mix UV inhibitor, antioxidant, and fire retardant, as understood in the art. The sheet panel 10 is 78 inches wide and 100 feet in length.

Strands 16, 16*a,* and 18 are parts of a fabric reinforcing layer, which includes also knitting yarn tying threads which tie strands 16, 16*a,* and 18 into a fabric. These are not shown in the drawing, but are as shown at 14 in FIG. 1 of the incorporated-by-reference U.S. Pat. No. 4,468,422, strands which zig-zag in a net warp direction between adjacent warps 16,16 or 16,16*a,* successively over and under, crossing halfway between the nearest fill threads. This tie yarn is of twenty-four filament 70 denier high tenacity polyester, Kosa No. 787. This form of fabric making is called "weft insertion", and warp strands 16 and 16*a* and fill threads 18 are not interwoven in any other way.

Alongside a longitudinal edge 20 of sheet 10 is a longitudinal mounting area with different reinforcing thread characteristics than elsewhere warp-wise in sheet 10. In the mounting area, warp threads number forty, alternating from the outboard edge 20 between pairs of 1000 denier polyester yarn 16 (each pair weft-knitted as if a single yarn and here called a "thread") and singles of 1300 denier yarns (of 240 filaments each) of UHMWPE 16*a*. The other warp threads throughout sheet 10 are singletons of 1000 denier polyester (not shown) just as is one half 18 of a doubleton thread. All the fill strands 18 are knitted in pairs as shown in the drawing, each pair of yarns 18 being knitted as though a single thread, and treated as such for thread count purposes. Effective thread count is 9×9 throughout (both warp and fill) sheet 10, nine per inch throughout both the mounting area adjacent edge 20 and the remainder of the sheet.

(The word "thread" is used herein to be generic to yarn, strand, and one meaning of thread (the housewife's): it is used to mean whatever is in a group that is treated as one element from the standpoint of the knitting machine. Thus, if two yarns, a doubleton of yarns, are treated as one in how they are fed to and acted on by the knitting machine, they are referred to herein as a thread. For example, in the expression "thread count".)

The polyester yarn 16 and 18 is sold by Kosa, Highway 70, Salisbury, N.C., as its Type 784, as a low-shrink, high-tenacity, antiwicking-treated yarn. Its tenacity is 7.8 grams per denier, and its breaking strength is 17.2 pounds for a 1000 denier strand, and twice that for a doubleton thread using such strands.

The UHMWPE yarn 16*a* is sold by Allied Signal Inc. under the mark and style SPECTRA 1300. Its tenacity is 34 grams per denier, and the breaking strength of a 1300 denier strand (singleton thread) is 95 pounds.

We use, throughout, the following terminology, as set forth in *Dictionary of Fiber & Textile Technology* (Hoechst Celanese 1990). "Tenacity" is tensile stress expressed as force per linear unit of unstressed specimen diameter (e.g., grams per denier). "Breaking tenacity" is tensile strength, so expressed, at rupture. "Breaking strength" is the total internal stress at rupture, expressed (e.g.) in pounds.

Interrelations among the elements of the panel combinations are complex, and can produce surprising results. Thus, although moving a particular aramid yarn from a PVC single ply structure into a polypropylene single ply structure may weaken uplift wind resistance, the reverse (substituting the same UHMWPE threads from a polypropylene single ply to a PVC) may again weaken uplift wind resistance.

In manufacture, warp threads are continuously fed into the weft-knitting machine, source rolls being successively knotted together to avoid interruption. Fill threads go in one transverse direction from a group of spools (say 20, or maybe 40), and then in the opposite direction as a group, the first fill thread of a successor group adjoining the last fill thread of the predecessor group. Hooks cooperate with tie threads to orient them as they move in a zigzag way in a generally warp direction. The weft-knitted fabric is then longitudinally slitted in half, to produce two lengths of fabric each 80 inches in width, each of which is then formed into a large roll, the fabric on it being in length many times that of an ultimate panel.

In due course, each roll of fabric is placed into an extruder line, and coated on its fill side (with, e.g., polypropylene) to provide base layer portion 12, to a thickness about half that desired of the finished product, following which the half-coated fabric is turned over and the other face given a corresponding coating from a second extruder. The two layers of plastic unite into a single ply between the reinforcing threads and also slightly beyond the fabric edges on each transverse side. The originally outermost edges are then trimmed off, to produce a sheet 78 inches wide. The product is then cut to any desired length, preferably 100 feet, and formed into a roll, with the warp threads and white side toward the center of the roll.

Preferably a line of marks is imposed on the inner surface along a longitudinal line corresponding to the transverse centerline of the mounting area, spaced as it is intended the holddown plates to be spaced. These marks inform workmen where to insert the fasteners for the holddown plates, the fasteners themselves making the needed holes in the panels.

The premarked spacing for the fasteners and hold down plates is six inches.

The presently preferred hold down plates have an outside diameter of 2⅜ inches, and the four-inch mounting strip width provides needed allowance for manufacturing and installation variables and for edge spacing.

The presently preferred plates and fasteners are the Olympic XHD plate and screw system, with the 2⅜ inch diameter round steel plate, of 0.040 inch thick AZ-55 galvalume steel and with the fastener size #15 with a #3 Phillips truss head. The plate has deformed into a generally flat top portion a pair of upwardly convex in radial cross-section annular depressions, circular cylindrical centerplanes of the depressions being spaced radially about the same from each other and from the OD and center of the plate. Extending downwardly from the top portion of the plate are a half-dozen circumferentially equally spaced struck-out barbs extending generally perpendicularly to the undeformed top portions of the plate, for a distance of 0.120 inches each. The lower plate portion is deformed into a frustoconical wall terminating in a planar annulus generally parallel to the upper generally flat portion surrounding the hole for the screw. At the center of the plate is a 0.275 inch hole to accept the fastener, which may be of from two to fourteen inches in length, and should protrude at least one-half inch from a typical steel deck base. Screws are of C1022 carbon steel, and have an E-coat CR-10 coating.

OTHER EMBODIMENTS

Other embodiments will occur to those in the art and are within the claims that follow.

The sheet material may be other than polypropylene: for example polyvinyl chloride or chlorinated polyethylene.

The reinforcing strands or threads of higher tenacity and breaking strength may be, for example, of aramid.

Panel size may of course vary, as may sheet thickness.

We claim:

1. A roofing panel comprising:

a single-ply plastic sheet and a fabric reinforcing element, said element being embedded in said sheet, being weft-inserted, including a mounting area, said area being toward and alongside an edge of said panel, said area being slightly wider than holddown plates with which said panel is to be used and extending longitudinally along said panel, and said area including UHMWPE threads, said threads being transversely spaced and parallel with said edge.

2. The panel of claim 1 in which said plastic is polypropylene.

3. A roofing panel comprising:

a single-ply plastic sheet and a fabric reinforcing element,
said element being embedded in said sheet,
being weft-inserted,
including a mounting area,
said area being toward and alongside an edge of said panel,
said area being slightly wider than holddown plates with which said panel is to be used and extending longitudinally along said panel, and
said area including first threads of a first higher tenacity and second threads of a second lower tenacity,
said threads being transversely spaced and parallel with said edge.

4. The panel of claim 3 in which said first threads are of aramid.

5. The panel of claim 4 in which said plastic is PVC.

6. The panel of claim 3 which includes a multiplicity of spaced third threads of a tenacity lower than said first tenacity, said third threads being perpendicular to said first threads and said second threads.

7. The panel of claim 3 which includes a multiplicity of fourth threads, said fourth threads being spaced from one another, being parallel to said first threads, and being of tenacity less than said first tenacity.

8. The panel of claim 7 which includes a multiplicity of spaced third threads, said threads being perpendicular to said first, second, and fourth threads, and having a tenacity lower than said first tenacity.

9. The panel of claim 8 in which said first threads are single strand and said second threads are double strand.

10. The panel of claim 9 in which said third threads are double strand and said fourth threads are single strand.

11. The panel of claim 10 in which the breaking strength of said second, third, and fourth threads is less than the breaking strength of said first threads.

12. The panel of claim 11 in which said first threads are of UHMWPE.

13. The panel of claim 12 in which said plastic is polypropylene.

14. The panel of claim 11 in which said first threads are of aramid.

15. The panel of claim 14 in which said plastic is PVC.

16. The panel of claim 11 in which said fourth threads have a thread count the same as said first threads and said second threads in combination.

17. The panel of claim 16 in which said third threads have also the same thread count.

18. A roofing panel comprising:
a single-ply plastic sheet and
a fabric reinforcing element,
said element being embedded in said sheet, and
including a mounting area,
said area being alongside an edge of said panel,
said area including UHMWPE threads,
said threads being parallel with and spaced different distances from said edge.

19. The panel of claim 18 in which said area includes second threads of tenacity lesser than that of said UHMWPE threads and extending parallel therewith each of said threads being spaced from all other said threads.

20. The panel of claim 19 in which said UHMWPE threads and said second threads alternate.

21. The panel of claim 20 in which said UHMWPE threads are single strand and said second threads are doubleton strands of polyester.

22. The panel of claim 19 in which said threads are warp threads.

23. The panel of claim 22 in which said element is weft-inserted.

24. The panel of claim 23 in which said element is weft-inserted.

25. The panel of claim 24 in which said area is four inches wide.

26. The panel of claim 18 in which said sheet is of polypropylene.

27. The panel of claim 26 in which said sheet is of very flexible said polypropylene.

28. The panel of claim 26 in which said sheet is single ply.

* * * * *